United States Patent [19]

White

[11] Patent Number: 4,472,709

[45] Date of Patent: Sep. 18, 1984

[54] ALARM FOR A SLIDING DOOR OR THE LIKE

[76] Inventor: John D. White, 3705 Brunswick Dr., Toledo, Ohio 43606

[21] Appl. No.: 525,952

[22] Filed: Aug. 24, 1983

[51] Int. Cl.[3] ..... G08B 13/08

[52] U.S. Cl. ..... 340/546; 200/61.73; 200/61.93

[58] Field of Search ..... 340/546, 545; 200/61.93, 61.73, 61.74, 61.71, 61.75

[56] References Cited

U.S. PATENT DOCUMENTS

| | | | |
|---|---|---|---|
| 2,870,281 | 1/1959 | Mitchell | 340/546 |
| 3,402,405 | 9/1968 | Contreras | 340/545 |
| 3,797,005 | 3/1974 | Schwarz | 340/545 |
| 3,797,006 | 3/1974 | Reininger | 340/545 |
| 4,193,067 | 3/1980 | Hawkins | 340/546 |
| 4,266,216 | 5/1981 | Trusty | 340/546 |

*Primary Examiner*—Glen R. Swann, III

*Attorney, Agent, or Firm*—Allen D. Gutchess, Jr.

[57] ABSTRACT

An alarm for a sliding door or the like is provided. The alarm is operatively associated with a movable frame and a stationary frame of a sliding door assembly. It has a plunger engagable with one frame or the other, which plunger is urged outwardly and activates a signal if the alarm is removed from its position. The alarm includes a case in which a modular component can be inserted with the component including a source of power, contacts, and a signal which can be an audible signal or a sending signal which activates a remote burglar alarm. The case of the alarm has a lock which can lock the plunger in place when the alarm is removed by the occupant. The plunger is also designed to be prevented from being pushed back into the case to turn off the alarm without the use of an elongate element insertable into an access opening in the case.

20 Claims, 6 Drawing Figures

ALARM FOR A SLIDING DOOR OR THE LIKE

This invention relates to a burglar alarm for use with a sliding door or the like.

Alarms of this nature are known in prior art, such as in the Schwarz U.S. Pat. No. 3,797,005. In this patent, the alarm includes a plunger which activates a signal if the plunger is pushed in. However, if a window panel is broken and the alarm is removed, no signal will be activated. Mitchell U.S. Pat. No. 2,870,281 has a somewhat similar alarm which is used between a floor and a door knob to activate a signal if the door is attempted to be opened. Hawkins U.S. Pat. No. 4,193,067 shows an alarm which is similar in operation to that of the Schwarz patent.

The present invention provides an alarm for a sliding door assembly or the like which is designed to be positioned between a sliding door frame and a stationary frame of the sliding door assembly. The alarm includes a plunger which normally is engaged with the movable or stationary frame and activates a signal if the alarm is removed. Thus, the alarm is designed to prevent opening of the door by physical obstruction therewith. However, if an intruder breaks a glass panel and moves the alarm out of the way, the signal will then sound.

The alarm in accordance with the invention includes an adjustable rod member having one end adapted to engage the movable frame of the door or a stationary frame. At the other end of the rod member is a case containing a plunger which extends outwardly and engages the other of the movable and stationary frames. A spring urges the plunger outwardly and when the case is separated from the associated frame, the plunger does so move and activates a signal. The case also features a module chamber into which any of two or more modules can be selected and inserted. One module can contain a source of power in the nature of a battery, a pair of contacts which are engagable by the plunger when in its outer position, and an audible signal. Another module can be similar but contains a signal which emits a sending signal in the form of radio waves or the like to operate a remote burglar alarm. The appropriate module desired by the consumer can be quickly assembled into the case by the dealer or retailer at the time of sale of the alarm. This eliminates considerale inventory as compared to the situation where complete alarms containing either the audible signal or the sending signal are employed.

The alarm also includes a manually-operated lock which can prevent outward movement of the plunger when the occupant is to remove the alarm and open the door or the like. A further feature of the alarm is that the plunger, when it does move outwardly and activates the signal, cannot be pushed back into the case to turn off the signal without use of an elongate element inserted into an access opening in the case.

It is, therefore, a principal object of the invention to provide an alarm for a sliding door or the like having the features and advantages discussed above.

Many other advantages and objects of the invention will be apparent from the following detailed description of a preferred embodiment thereof, reference being made to the accompanying drawings, in which.

Figure 1:
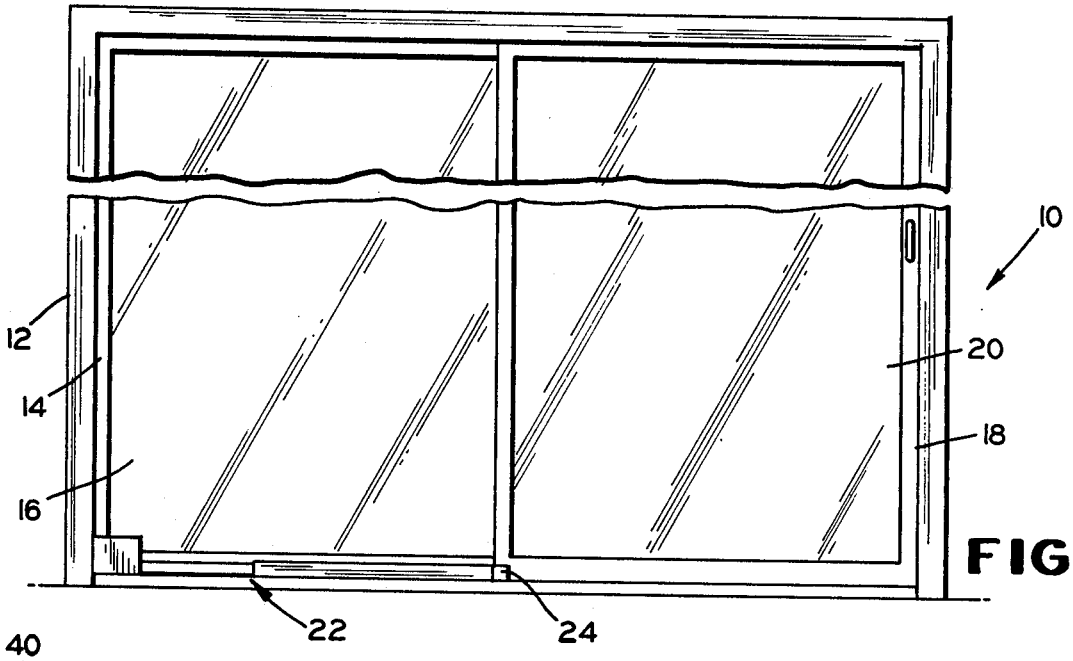
FIG. 1 is a view in elevation of a sliding door assembly and an alarm embodying the invention.

Referring to the drawings and particularly to FIG, 1, a sliding door assembly or the like is indicated at 10. This assembly could also be in the nature of a sliding window assembly or similar structure. The sliding door assembly 10 includes an outer, stationary frame 12 having a stationary panel frame 14 with a glass panel 16 and a sliding door 18 with a glass panel 20. In this instance, the door 18 slides inside the stationary panel.

A burglar alarm 22 in accordance with the invention is mounted between the sliding door frame 18 and the stationary frame 12. If the door 18 slides on the outside of the stationary panel, then a bracket or the like can be mounted on the door 18 to engage an end of the alarm 22, with the other end engaging the stationary frame 14. Otherwise, as shown, the alarm can have a bracket 24 which is of U-shaped configuration as viewed from above and which engages the edge of the door 18.

Figure 2:
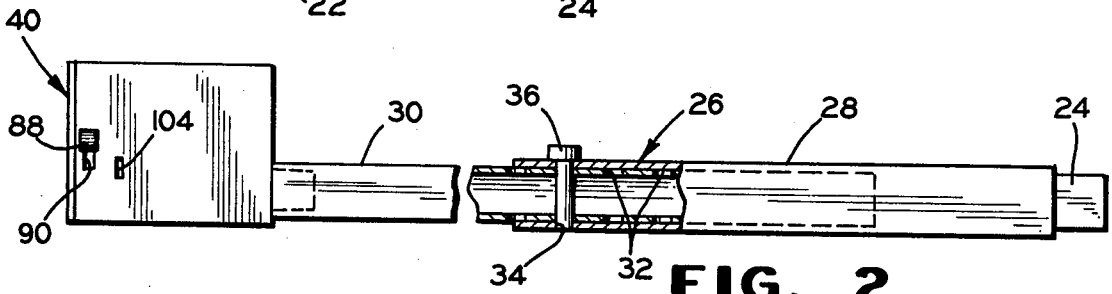
FIG. 2 is an enlarged view, with parts broken away, and with parts in section, of the alarm of FIG. 1.

The alarm 22, referring to FIG. 2, includes an elongate adjustable blocking member 26 comprising an outer tubular member 28 on which the bracket 24 is mounted and an inner tubular member 30 which telescopes into the member 28. The members are adjustable with the inner member 30 having a plurality of longitudinally-spaced, aligned holes 32 therein and the outer member 28 having holes 34 therein through which a pin 36 is inserted. The pin is inserted into any of the aligned holes 32 in the inner member 30 for longitudinal adjustment of the blocking member 26.

The inner member 30 is internally threaded at its outer end and receives a threaded nipple 38 on a case 40 constituting part of the alarm. The case 40 has a back wall 46, a bottom wall 48, an upper wall 50, and side walls 52 and 54. A guide wall 56 extends between the side walls 52 and 54 and divides the interior of the case into an upper module chamber 58 and a lower plunger chamber 60.

Figure 6:
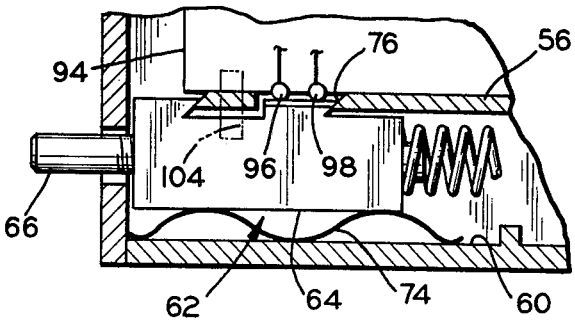
FIG. 6 is a further enlarged, fragmentary view in section of a portion of the case and components of FIG. 3, with the components shown in a different position.

A plunger 62 has a plunger body 64 located in the plunger chamber 60 and a plunger pin 66 extending forwardly therefrom. The plunger pin 66 is preferably adjustable relative to the body 64 and for this purpose is shown as threaded and received in a threaded bore in the body. The plunger body 64 has a rear, upwardly-extending, projection 68 with a conducting strip 70 thereon and can also have a forward, upwardly-extending projection 72. The plunger body is urged upwardly by an undulated leaf spring 74 located between the plunger body and the bottom wall 48 of the case 40. The conducting strip 70 and the upper surface of the forward projection 72 thus engage and slide along the bottom surface of the guide wall 56 except when the rear projection 58 extends through an opening 76 in the guide wall 56, at which time the forward projection 72 also extends upwardly in front of the forward edge of the guide wall 56, as shown in FIG. 6. The plunger 62 is also urged forwardly by a resilient coil spring 78 seated on a rear pin 80 of the plunger body 64 and against the rear wall 46 of the case 40.

The plunger pin 66 is urged outwardly through an elongate slot 82 in a forward wall or removable cover 80 of the case 40 until it engages the frame with which it is associated. The plunger 62 then remains in that position until the alarm 22 is removed and the plunger pin 66 is free of the frame, at which time the spring 78 urges the plunger body 64 farther outwardly with the spring 74 then urging the rear projection 68 and the conducting strip 70 upwardly into the opening 76 of the guide wall 56.

Figure 5:
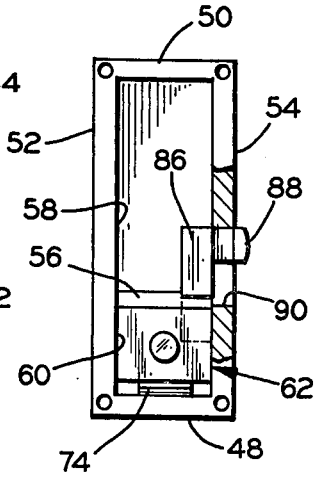
FIG. 5 is a left end view of the case of FIG. 3 with the cover removed, and with parts broken away and with parts in section.

The plunger 62 can be prevented from moving to the outer position by means of a locking tab 86 (FIG. 5) which has a handle 88 extending through a slot 90 in the side wall 54 of the case 40. The handle 88 can be pushed downwardly to move the locking tab 86 in front of the plunger body 64 to limit outward movement of the plunger 62 even when the alarm is removed.

Figure 3:
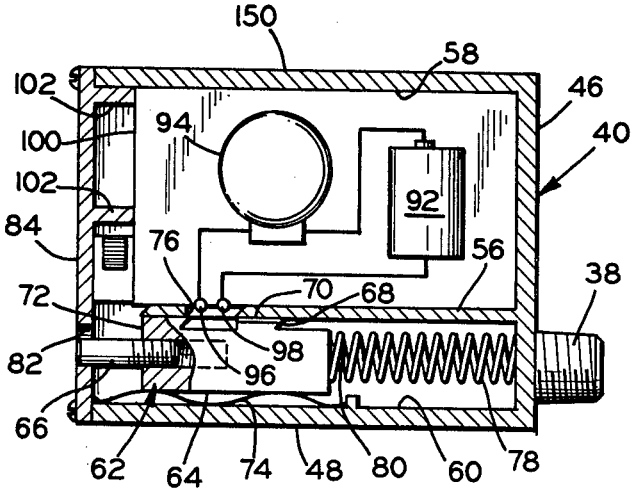
FIG. 3 is a somewhat schematic view in vertical cross section through a case and components of the alarm.
Figure 4:
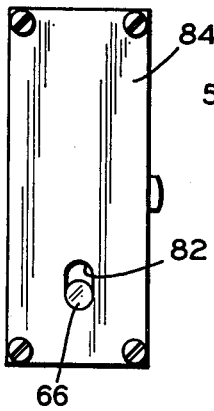
FIG. 4 is a left end view of the case of FIG. 3.

A signaling system is located in the compartment 58 and is activated by the plunger body 64 when the plunger moves outwardly. As shown in FIG. 3, the signaling system includes a source of power, shown as a battery 92, connected in series with a signal 94, shown as a buzzer, with two electrical contacts 96 and 98 aligned with the guide wall opening 76. When the conducting strip 70 engages both of the contacts 96 and 98, a circuit is completed to cause the signal 94 to be activated. Besides being a sound signal, the signal can also emit sending waves in the form of radio waves or the like to activate a remotely located burglar alarm. This sending unit can be similar to a hand-carried signal for a garage door opener.

In a preferred form, the signaling system is mounted in a module 100 which can be inserted into the compartment 58 when the front cover 84 of the case 40 is removed. The module 100 can then be held in position by ribs or flanges 102 on the cover 84 when it is replaced. Sufficient space for the locking tab 86 is thereby provided.

The module 100 has the advantage that it can be inserted in the case 40 at the time of sale to the consumer to meet the consumer's requirement for a sound signal or a sending signal in the signaling system. This eliminates the need for having completely separate alarms 22 for each of the types of signals. The module can also be readily removed for repair or battery replacement.

Another feature of the alarm 22 in accordance with the invention is that the plunger rim 66 cannot be readily pushed back by the burglar into the case to shut of the alarm. This occurs because the projection 68 engages the rear edge of the opening 76 in the guide wall 56 and the projection 72 can operate similarly with respect to the front edge of the guide wall. To retract the plunger, an elongate access opening 104 is located in the side wall 54. An elongate element such as an ice pick or a tooth pick can then be inserted through the opening 104 and pressed against the plunger body 64 between the projections 68 and 72. This forces the body downwardly against the force of the spring 74 to move the projections below the lower surface of the guide wall 56, at which time the plunger pin 66 can be pushed toward the case to move the plunger back to the position of FIG. 3. The occupant can have such an element available whereas the ordinary burglar intruder would not have both the knowledge of how to retract the plunger and the element to do so readily available.

Rather than having the plunger body itself spring loaded upwardly by the spring 74, a resilient conducting contact can be carried by the body and moved upwardly where into the guide wall opening 76 when aligned therewith. This resilient contact could then be moved downwardly by the elongate instrument out of the opening 76 to enable the plunger to be retracted.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. A burglar alarm for a sliding door or the like comprising a rod member having one end adapted to engage one of a movable frame of the door and a stationary frame, a case located at the other end of said rod unit, a plunger extending outwardly from said case and adapted to engage the other of said door frame and said stationary frame, resilient means urging said plunger outwardly toward the associated frame, an alarm system in said case comprising a source of power, signal means connected with said source of power, and a pair of electircal contacts connected with said source and said signal means, said plunger having conducting means engagable with said contacts when said plunger moves further outwardly of said case under the force of said resilient means when the plunger is moved away from the associated frame to cause said power source to activate said signal means.

2. A burglar alarm according to claim 1 characterized by lock means movably mounted on said case and having a first position spaced from said plunger and a second position engagable with said plunger to prevent movement of said plunger out of said case when the plunger is moved away from the associated frame.

3. A burglar alarm according to claim 1 characterized by said plunger being prevented from being pushed inwardly into said case when said conducting means engages said electrical contacts.

4. A burglar alarm according to claim 3 characterized by said case having an access opening through which an element can be inserted or enabling said plunger to be pushed into said case.

5. A burglar alarm according to claim 1 characterized by said plunger having a plunger body in said case and a plunger pin extending through an opening in a wall of said case.

6. A burglar alarm according to claim 5 characterized by said plunger pin being longitudinally adjustable relative to said plunger body.

7. A burglar alarm according to claim 1 characterized by said source of power, said signal means, and said pair of electrical contacts being located in a module separable from said case.

8. A burglar alarm according to claim 1 characterized by said case having a guide wall therein having an opening with which said contacts are aligned, said conducting means engaging said contacts through said opening when said plunger is moved further outwardly.

9. A burglar alarm according to claim 8 characterized by said case having an access opening through which an elongate element can be inserted to enable said conducting means to be separated from the guide wall opening whereby said plunger can be pushed back into said case.

10. A burglar alarm for a sliding door or the like comprising a rod member, a case attached at one end to said rod member, said case having a guide wall therein dividing the interior into a module chamber and a plunger chamber, said case having a removable cover for inserting a module into said module chamber, a plunger having a plunger body located in said plunger chamber and a plunger pin extending outwardly from said case, means in said plunger chamber urging said plunger pin outwardly, said plunger having conducting means engagable with electrical contacts of a module in said module chamber to activate a signal in the module when said plunger is in its outermost position.

11. A burglar alarm according to claim 10 characterized by said plunger body having a projection carrying said conducting means and engagable with said guide wall when in its outermost position to prevent movement of said plunger inwardly into the case.

12. A burglar alarm according to claim 11 characterized by said case having an access opening into which an elongate element can be inserted to enable said projection to be separated from said guide wall whereby said plunger can be moved back into said case.

13. A burglar alarm according to claim 10 characterized by said plunger pin being longitudinally adjustable relative to said plunger body.

14. A burglar alarm for a sliding door or the like having a movable frame slidable in a stationary frame, said alarm comprising an adjustable blocking member having one end adapted to engage one of said movable frame and said stationary frame, a case affixed to the other end of said blocking member and having a guide wall therein dividing the interior into a module chamber and a plunger chamber, a plunger having a plunger body movable longitudinally in the plunger chamber and having a plunger pin extending through an opening in a wall of said case, said plunger pin being adapted to engage the other of said movable frame and said stationary frame, an alarm module receivable in said module chamber and containing a power source, a signal source, and electrical contact means, said guide wall having an opening therein aligned with said electrical contact means of said module, said plunger body having engagable means engagable with said electrical contact means through said guide wall opening when said plunger is in an outer position, first resilient means in said plunger chamber urging said plunger toward the outer position, said case having a removable cover through which said module can be inserted into said module chamber, second resilient means urging said engagable means toward said electrical contact means, said plunger being prevented from being pushed into said plunger chamber when said engagable means is engaged with said electrical contact means, and locking means engagable with said plunger body in one position to prevent said plunger from moving outwardly, and being spaced from said plunger body in another position.

15. A burglar alarm according to claim 14 characterized by said plunger pin being longitudinally adjustable relative to said plunger body.

16. A burglar alarm according to claim 14 characterized by said second resilient means urging both said plunger body and said engagable means toward said electrical contact means.

17. A burglar alarm according to claim 14 characterized by said plunger being prevented from beig pushed into said plunger chamber when said engagable means is engaged with said electrical contact means, by said engagable means contacting an edge of said guide wall opening.

18. A burglar alarm according to claim 14 characterized by said second resilient means being located between said plunger body and a bottom wall of said case and urging said plunger body toward said guide wall.

19. A burglar alarm according to claim 17 characterized by said case having an access opening communicating with said plunger.

20. A burglar alarm according to claim 14 characterized by said removable cover having a hole through which said plunger pin extends.

* * * * *